US007770888B2

(12) United States Patent
Nakamura

(10) Patent No.: US 7,770,888 B2
(45) Date of Patent: Aug. 10, 2010

(54) PAPER-FEEDING DEVICE AND IMAGE FORMING APPARATUS

(75) Inventor: Mitsutaka Nakamura, Kanagawa (JP)

(73) Assignee: Ricoh Company Limited, Tokyo (JP)

( * ) Notice: Subject to any disclaimer, the term of this patent is extended or adjusted under 35 U.S.C. 154(b) by 20 days.

(21) Appl. No.: 11/902,713

(22) Filed: Sep. 25, 2007

(65) Prior Publication Data

US 2008/0084021 A1 Apr. 10, 2008

(30) Foreign Application Priority Data

Oct. 6, 2006 (JP) ..... 2006-275205
May 31, 2007 (JP) ..... 2007-145406

(51) Int. Cl.
*B65H 1/00* (2006.01)

(52) U.S. Cl. ..... 271/171

(58) Field of Classification Search ..... 271/171, 271/162

See application file for complete search history.

(56) References Cited

U.S. PATENT DOCUMENTS 3,921,972 A * 11/1975 Miller ..... 271/171
6,454,254 B2 * 9/2002 Yamaguchi et al. ..... 271/171
2006/0182485 A1 * 8/2006 Ogawa et al. ..... 400/647
2006/0232000 A1 10/2006 Takahashi et al.

FOREIGN PATENT DOCUMENTS

| | | |
|---|---|---|
| JP | 1-275333 | * 11/1989 |
| JP | 4-365727 | * 12/1992 |
| JP | 06-293462 | 10/1994 |
| JP | 08-113379 | 5/1996 |
| JP | 11-059922 | 3/1999 |
| JP | 11-278683 | * 10/1999 |
| JP | 2001-117431 | 4/2001 |
| JP | 2003-128270 | 5/2003 |
| JP | 2004-184799 | 7/2004 |
| JP | 2004-196433 | 7/2004 |
| JP | 2006-219275 | 8/2006 |

* cited by examiner

*Primary Examiner*—Patrick Mackey
*Assistant Examiner*—Thomas A Morrison
(74) *Attorney, Agent, or Firm*—Harness, Dickey & Pierce, P.L.C.

(57) ABSTRACT

A paper-feeding device for use in an image forming apparatus that includes a tray on which a recording sheet is configured to be stacked, the tray having an upper surface and a lower surface both being exposed to outside. Two side fences that are movably attached to the upper surface are used for adjusting a position of stacked recording sheet. Two side-fence position indicators indicate a position of the side fences.

17 Claims, 12 Drawing Sheets

PAPER-FEEDING DEVICE AND IMAGE FORMING APPARATUS

CROSS-REFERENCE TO RELATED APPLICATIONS

The present application claims priority to and incorporates by reference the entire contents of Japanese priority document, 2006-275205 filed in Japan on Oct. 6, 2006, and 2007-145406 filed in Japan on May 31, 2007.

BACKGROUND OF THE INVENTION

1. Field of the Invention

The present invention relates to a paper-feeding device and an image forming apparatus. More particularly, the present invention relates to a mechanism that aligns sheets stacked on the paper-feeding device.

2. Description of the Related Art

Image forming apparatuses including copiers, facsimiles, and printing machines heat and fix a transferred image on a sheet-like recording medium such as recording paper and an overhead projector (OHP) film (hereinafter, "recording sheet") thereby obtaining a duplicated or printed output.

In a typical image forming apparatus, one of recording sheets stacked on a sheet cassette or a sheet tray provided with the image forming apparatus is sequentially conveyed to a transfer position.

In most cases, recording sheets with a frequently-used size are stacked on the sheet cassette or the sheet tray. For less frequently-used recording sheets or special sheets, Japanese Patent Application Laid-open No. 2006-219275 discloses an image forming apparatus that additionally includes a manual paper-feeding device.

The manual paper-feeding device is a cover capable of opening and closing. The cover is attached to a side wall of a housing of the image forming apparatus. Recording sheets can be staked on an upper surface of the manual paper-feeding device when it is open.

Japanese Patent Application Laid-open No. H11-59922 discloses a plate-like manual paper-feeding device provided with side fences on the upper surface for aligning side edges of the recording sheets. The side fences are a pair of guide fences each arranged parallel to each other and orthogonal to a feeding direction (hereinafter, "sheet-width direction"). The pair of side fences symmetrically moves with response to a center line therebetween by a mechanism using a pinion that meshes with racks. The pinion is arranged on the center line.

With remarkable downsizing of image forming apparatuses, image forming apparatuses can be installed on various locations.

An image forming apparatus is usually placed on the floor in an office. However, a downsized image forming apparatus can be placed not only on a desk but also at a position higher than a user's seated position. The position higher than the user's seated position corresponds to a highest level of a rack on which a computer can be mounted, a shelf that is placed on the desk, and the like.

When placed at a position higher than the user's seated position, the image forming apparatus is above the user's eye level.

For this kind of image forming apparatuses, recording sheets are used as copy output material. The recording sheets need to be refilled, or special sheets other than the recording sheets of a predetermined form are sometimes used. Accordingly, some image forming apparatuses are equipped with a feed cassette that can accommodate the recording sheets of the predetermined form, and, in addition to the feed cassette, a manual paper-feeding device on which sheets can be stacked, to feed special sheets.

An example of the manual paper-feeding device is explained below. Part of a side wall of the image forming apparatus includes a lid-like member that is capable of opening and closing. The lid-like member is tilted outward from the side wall of the apparatus to be opened and expose a face on which sheets are stacked, thereby forming a position in which the apparatus can feed special sheets and the like.

As another configuration for manual feeding other than the configuration that enables manual feeding by opening part of the side wall of the image forming apparatus, a sheet tray that is housed in the apparatus is pulled out to expose the stack face, thereby forming a position in which special sheets and the like can be fed.

The manual paper-feeding device having a configuration that is exposed outside the apparatus sometimes has side fences to align side edges of the sheets that are stacked on the stack face. Even when the image forming apparatus is placed at a position higher than the user's eye level, the side fences must be aligned with the side edges of the stacked sheets to prevent skew of the sheets.

To stack the sheets on the stack face when the stack face is higher than the user's eye level, the user tends to reach for the stack face and drop the sheets held in hand down on the stack face. In some cases, the user stands up each time to perform this task. Therefore, the operability is quite low.

Also, when the side fences are moved to be aligned with the side edges of the stacked recording sheets, the task as mentioned above is needed. To determine the positions of the side fences before the sheets are stacked, the user must stand up and look into the stack face from the above or the side. This procedure to prepare the recording sheets increases operation loads on the user who is seated.

The lid-like member that is installed in the manual paper-feeding device can be adapted to be moved up and down, to be lowered to the user's eye level. In such cases, a complicated mechanism like a lifting and lowering device is required, which leads to an increase in the cost of the apparatus.

SUMMARY OF THE INVENTION

It is an object of the present invention to at least partially solve the problems in the conventional technology.

According to an aspect of the present invention, there is provided a paper-feeding device for use in an image forming apparatus and attached to a main body of the image forming apparatus. The paper-feeding device includes a tray on which a recording sheet is configured to be stacked, the tray having an upper surface and a lower surface both being exposed to outside; two side fences that are used for adjusting a position of stacked recording sheet, the side fences being movably attached to the upper surface; and two side-fence position indicators that indicate a position of the side fences.

According to another aspect of the present invention, there is provided an image forming apparatus. The image forming apparatus include the paper-feeding device described above.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained below with reference to the accompanying drawings.

Figure 1:
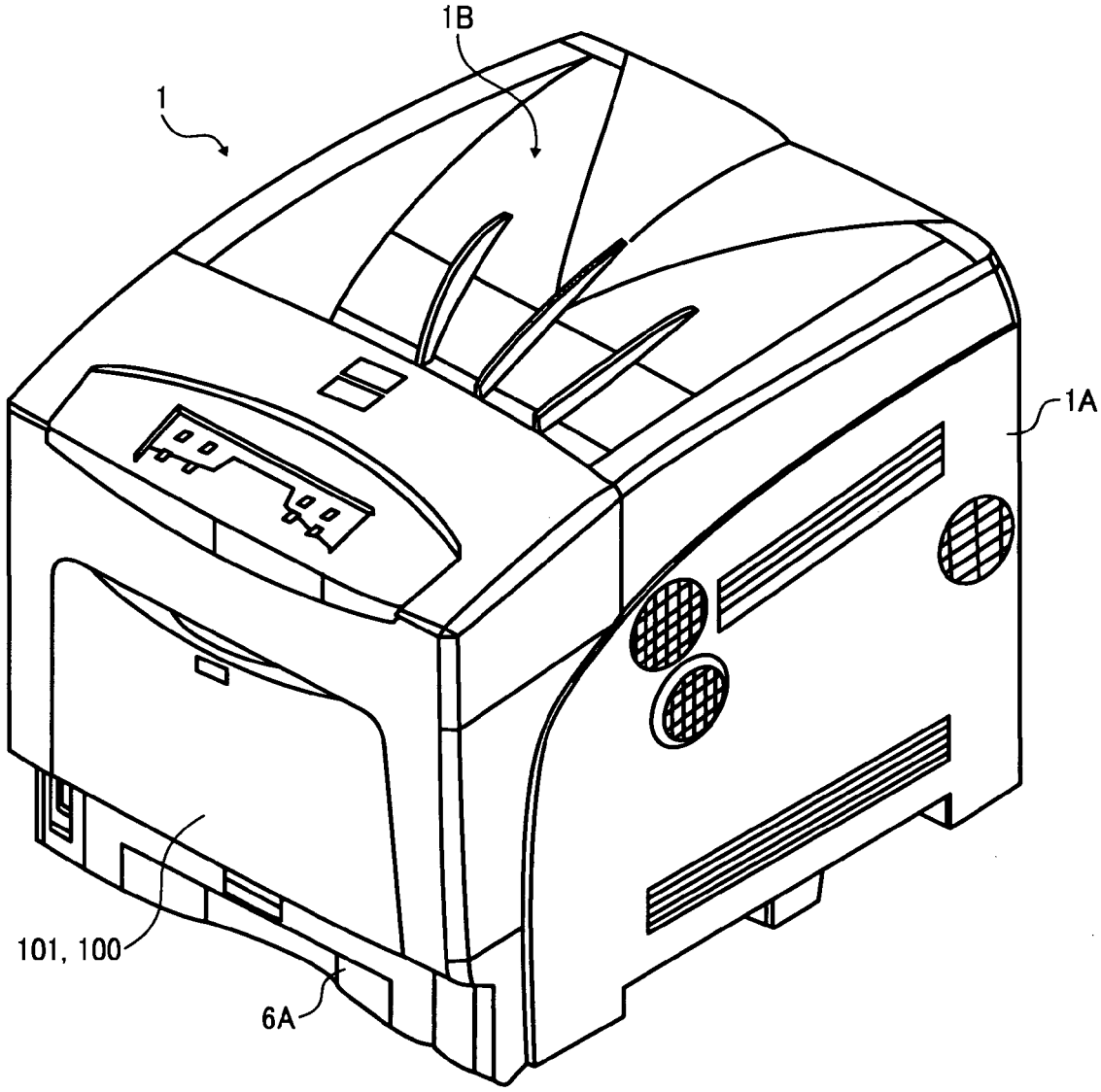
FIG. 1 is a perspective view of an image forming apparatus equipped with a manual paper-feeding device according to an embodiment of the present invention.

FIG. 1 is a perspective view of an image forming apparatus 1 equipped with a manual paper-feeding device 100 according to an embodiment of the present invention. Although the image forming apparatus 1 is a tandem-type full-color printer including an image forming unit for forming images in a different color as shown in FIG. 2, the image forming apparatus 1 can be a copier, a facsimile, and a printing machine.

The image forming apparatus 1 includes a receiving tray 1B on an upper surface of a housing 1A that defines the body of the image forming apparatus 1, and the manual paper-feeding device 100 on a side wall of the housing 1A. The manual paper-feeding device 100 includes a manual feed-tray 101.

Figure 2:
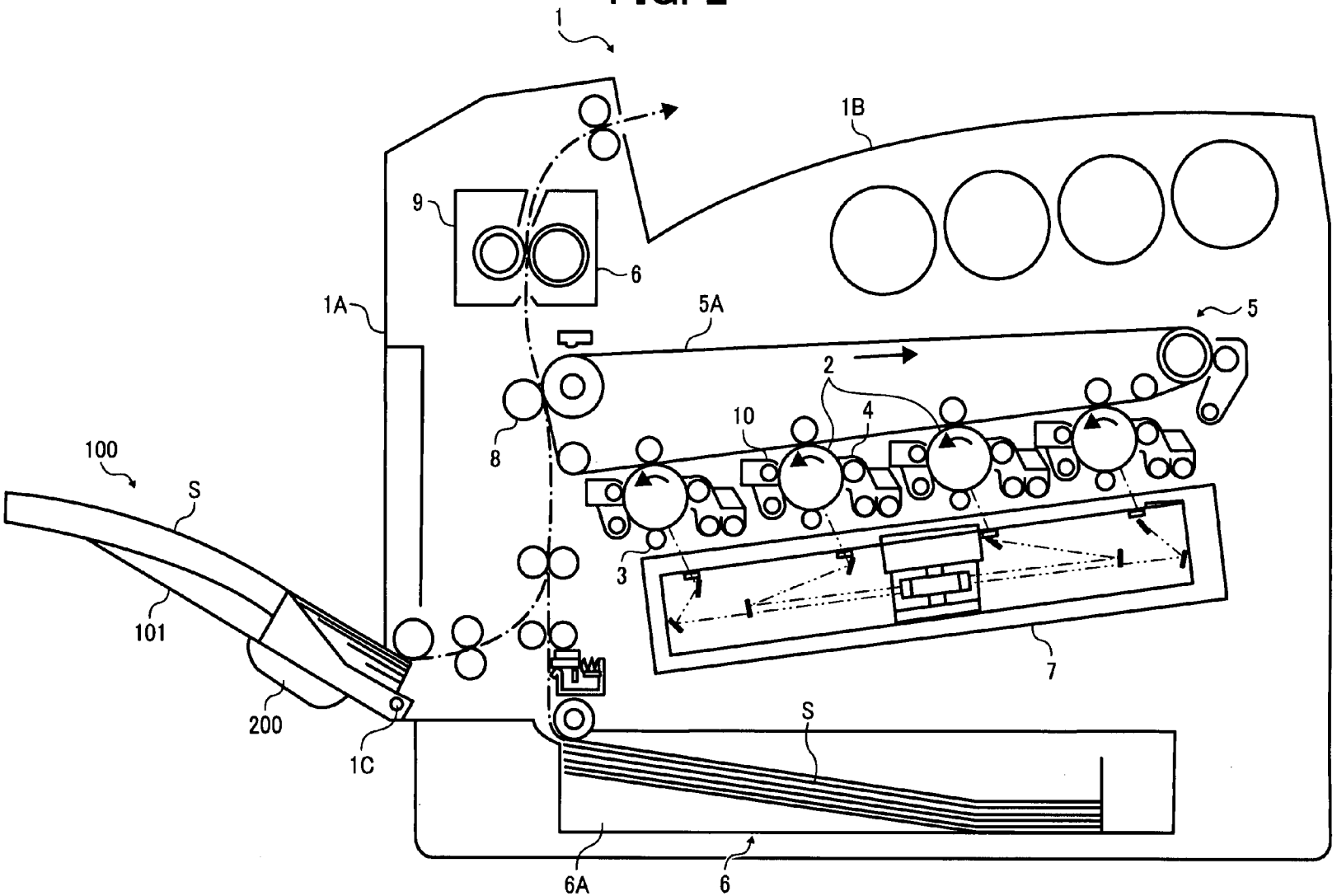
FIG. 2 is a side view of the image forming apparatus shown in FIG. 1.

The image forming apparatus 1 includes the image forming unit that forms images in a different color, as shown in FIG. 2. The image forming units includes a plurality of photosensitive drums 2, a transferring unit 5, and a writing unit 7 that forms a latent image on the charged photosensitive drum 2. Around the photosensitive drum 2, a charging unit 3, a developing unit 4, and a cleaning unit 10 are arranged in a rotation direction of the photosensitive drum 2.

The transferring unit 5 includes a transfer belt 5A that rotates in contact with the photosensitive drums 2. The transfer belt 5A is rotatably supported by a plurality of rollers.

Images formed by the image forming unit are transferred superimposingly onto the transfer belt 5A, and then collectively transferred by a secondary transferring unit 8 onto a recording sheet S that is conveyed from a feed cassette 6A of a paper-feeding device 6. The transferred image is fused and penetrated into the recording sheet S by heat and pressure by a fixing unit 9 whereby the transferred image is fixed on the recording sheet S. The recording sheet S on which the images are fixed is discharged through a discharging unit onto the receiving tray 1B.

The feed cassette 6A included in the paper-feeding device 6 can be removed from the housing 1A to replace or refill the recording sheets with a specific size. As shown in FIG. 1, the feed cassette 6A is located on the side on which the manual feed-tray 101 of the manual paper-feeding device 100, which is described later, is positioned, and below the manual feed-tray 101.

A carrying path of recording sheets that are conveyed from the manual paper-feeding device 100 joins a carrying path of recording sheets that are conveyed from the paper-feeding device 6.

The manual paper-feeding device 100 is for less frequently-used sheets or sheets made of a special material, other than the recording sheets with a specific size that are stacked on the feed cassette 6A. The manual paper-feeding device 100 that includes the manual feed-tray 101 is hinged to the housing 1A by a support pin 1C.

Figure 3:
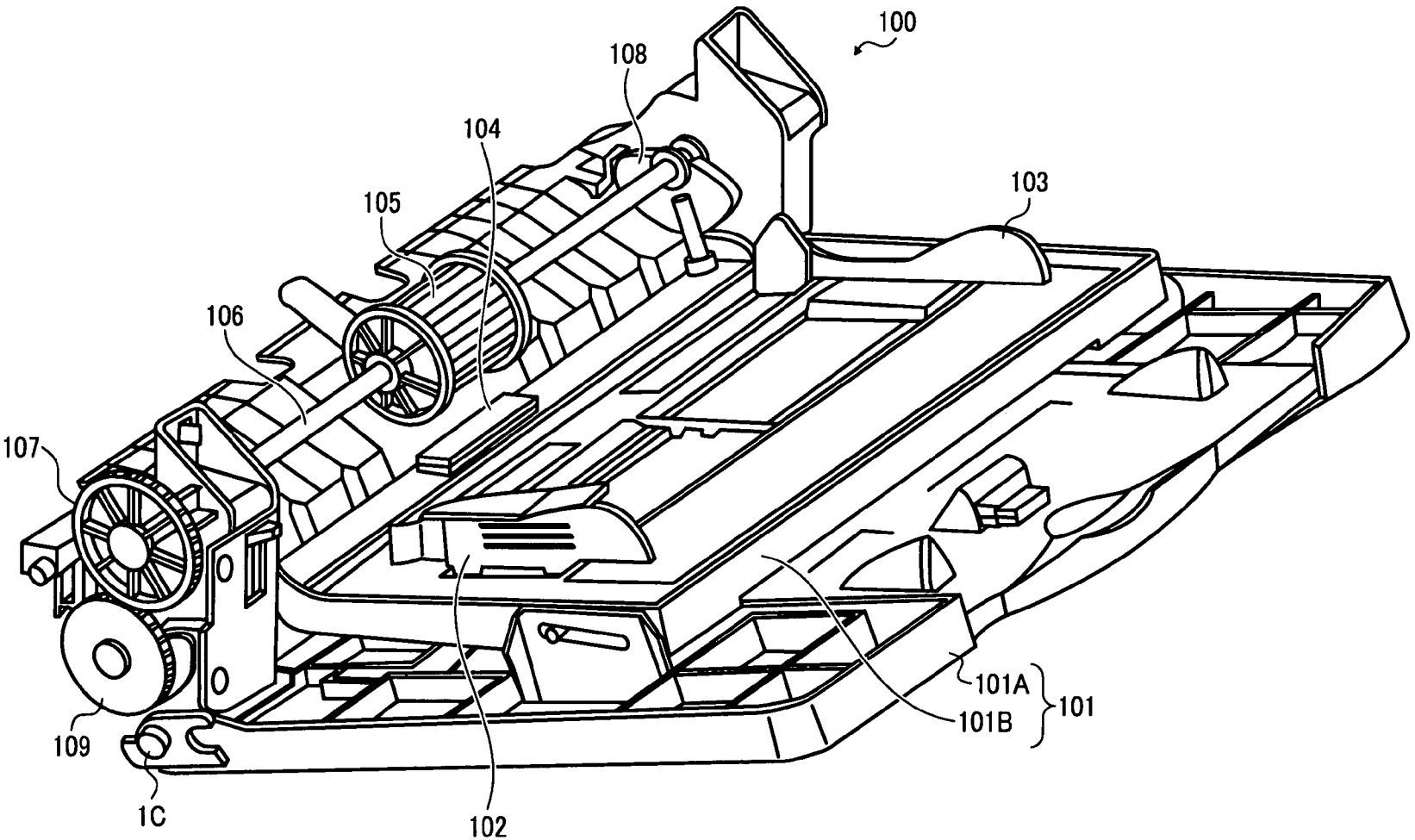
FIG. 3 is a perspective view of the manual paper-feeding device shown in FIG. 2.

The manual feed-tray 101 has, as shown in FIG. 3, a proximal end on which the support pin 1C is located. The manual feed-tray 101 includes a cover 101A that forms a part of a side wall of the housing 1A when the manual paper-feeding device is closed, and a stack plate 101B having a stack face that is located inside of the cover 101A.

Although not shown, the stack plate 101B is urged upward from the bottom thereof, and is restricted by an eccentric cam 108, which makes it impossible to move beyond the eccentric cam 108.

On the stack face of the stack plate 101B, a pair of side fences 102 and 103 that can move along the sheet-width direction that is orthogonal to the feeding direction of the stacked sheets are provided to align side edges of the sheets. A friction pad 104 and a feeding roller 105 that faces and abuts against each other are placed rearward of the feeding direction relative to the side fences 102 and 103.

For the side fences 102 and 103, as described for example in Japanese Patent Application Laid-open No. H11-59922, a mechanism using racks and a pinion is used. In the mechanism, the racks supporting the side fences 102 and 103 independently and having their longitudinal sides arranged in parallel to the sheet-width direction are interlocked with the pinion that is located at the center of the width side of the sheets, so that when one of the side fences moves, the other one moves simultaneously.

The feeding roller 105 is rotatable supported by a rotation shaft 106. A driven gear 107 is attached to one end of the rotation shaft 106 and the eccentric cam 108 is attached to the other end. When the driven gear 107 is driven by a driving gear 109 that is connected to a driving system in the housing 1A, the feeding roller 105 rotates. The eccentric cam 108 rotates in response to the rotation of the feeding roller 105 and lifts the stack plate 101B abutting against the eccentric cam 108 thereby causing the stacked sheets in contact with the feeding roller 105.

When the stack plate 101B is in a lifted position, one of the sheets in contact with the feeding roller 105 is conveyed because a friction coefficient between the target sheet and the friction pad 104, a friction coefficient between the other sheets, and a friction coefficient between the target sheet and the feeding roller 105 are different. This prevents feeding of the overlapped sheets.

The manual feed-tray 101 includes, in addition to the side fences 102 and 103, side-fence position indicators 200 that indicates a position of the side fences for aligning the side edges of the stacked sheets.

Figure 4:
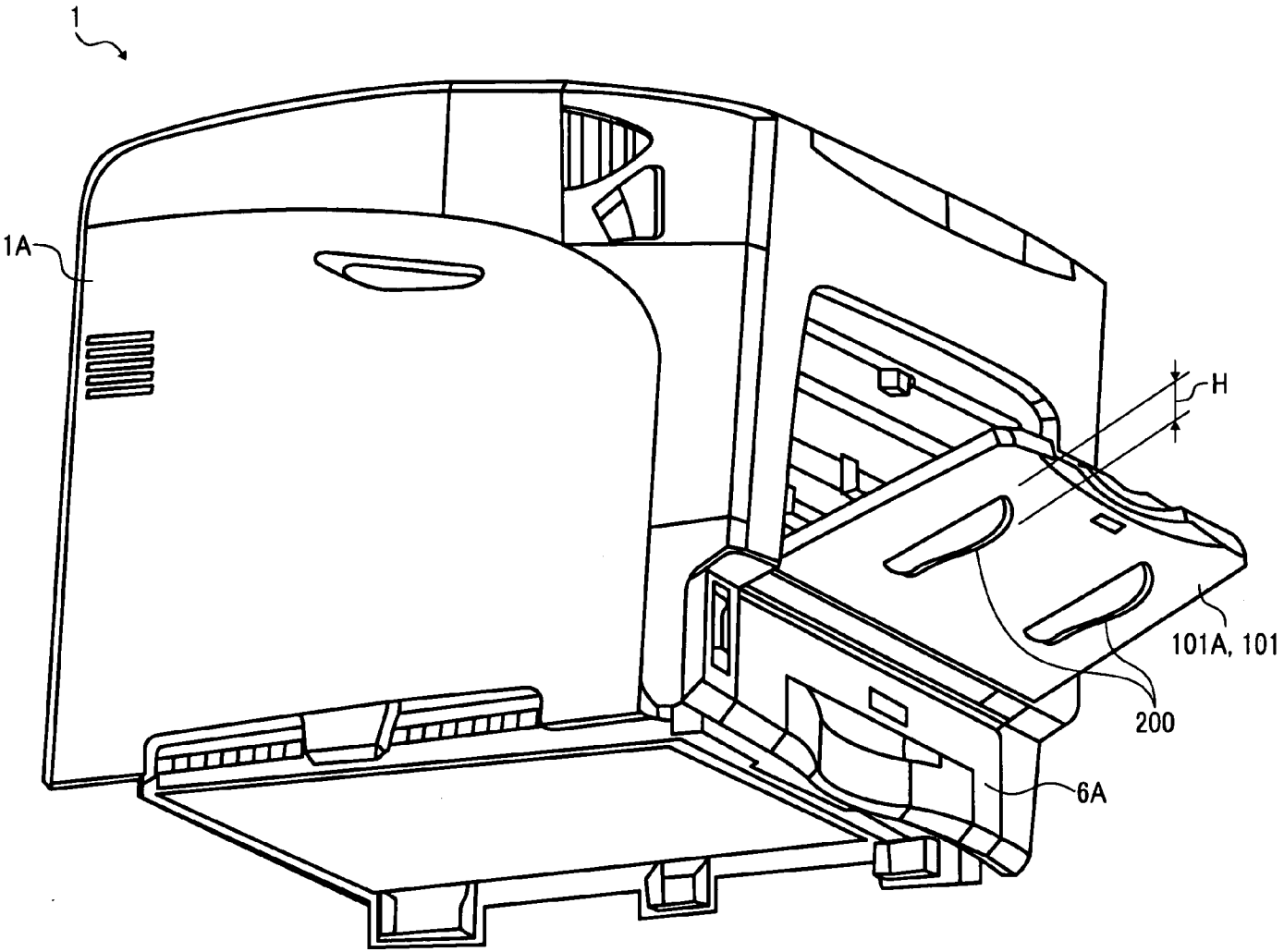
FIG. 4 is a perspective view from underneath of the image forming apparatus shown in FIG. 1.

As shown in FIG. 4, the side-fence position indicators 200 are provided on an outer surface of the cover 101A. The outer surface is an opposite surface of the stack face of the stack plate 101B on which the side fences 102 and 103 are provided. That is, the outer surface is lower surface when the manual feed-tray 101 is in the open position. The side-fence position indicators 200 moves associated with the side fences 102 and 103.

Figure 5:
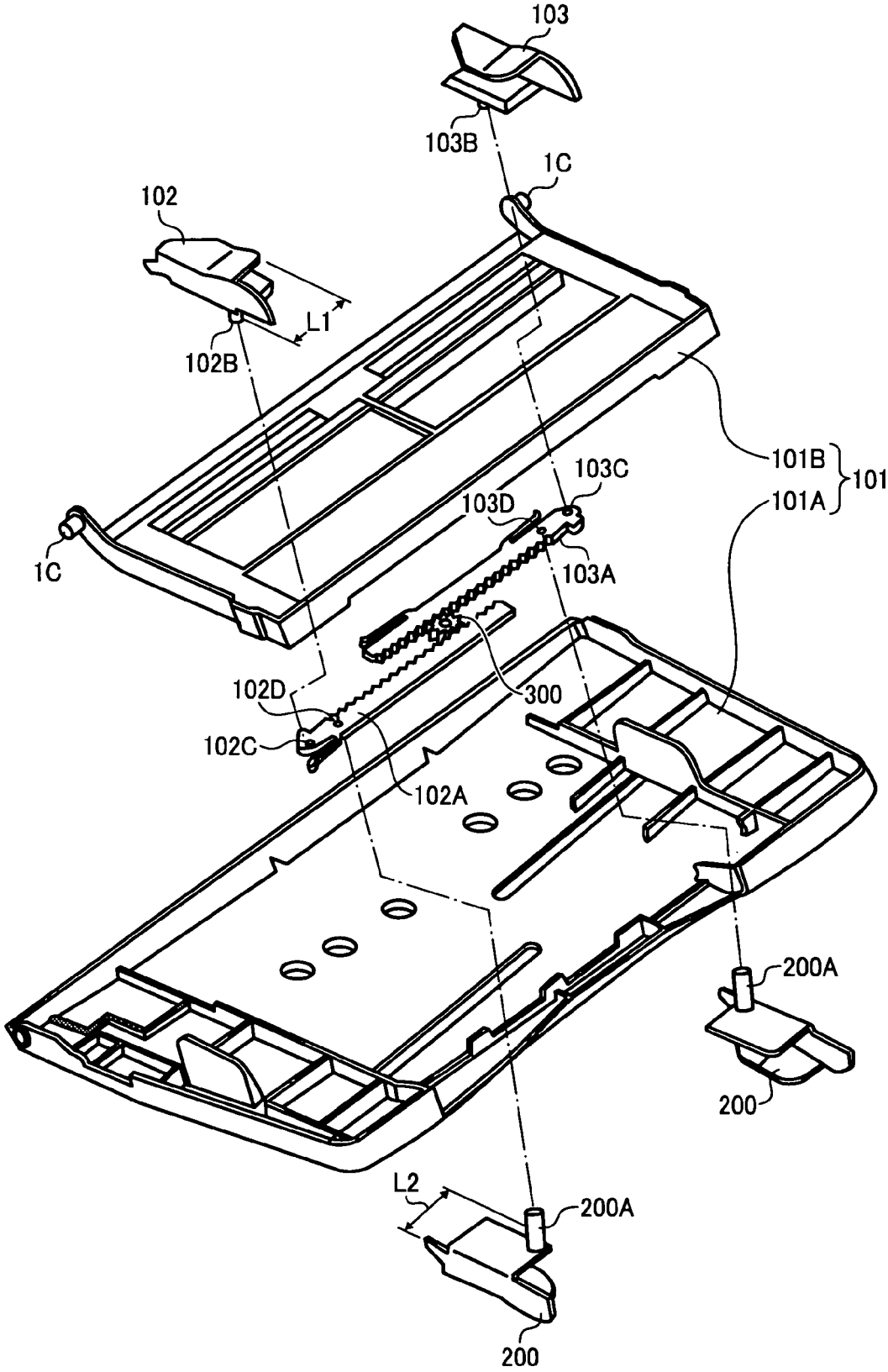
FIG. 5 is an exploded perspective view of the manual paper-feeding device shown in FIG. 3 for explaining a mechanism for interlocking side fences with side-fence position indicators.

The side-fence position indicators 200 are formed by a pair of fence members identical like the side fences 102 and 103. The side-fence position indicators 200 are removable members that are located on the outer surface of the cover 101A and move associated with the side fences 102 and 103 by a mechanism as shown in FIG. 5. Moreover, a rising height (H) of the side-fence position indicators 200 is set to a predetermined value not to interfere with opening and closing of the feed cassette 6A.

FIG. 5 is an exploded perspective view of the manual paper-feeding device 100 for explaining a mechanism for interlocking the side fences 102 and 103 with the side-fence position indicators 200. In the mechanism, racks 102A and 103A connect the side fences 102 and 103 with the side-fence position indicators 200. The rack 102A has a hole 102C for the side fence 102 and a hole 102D for a first one of the side-fence position indicators 200. The rack 103A has a hole 103C for the side fence 103 and a hole 103D for a second one of the side-fence position indicators 200. The side fences 102 and 103 include support rods 102B and 103B, respectively. The side-fence position indicators 200 include a support rod 200A, each. The support rod 102B is penetrated into the hole 102C; the support rod 103B into the hole 103C; the support rod 200A of the first side-fence position indicator 200 into the hole 102D; and the support rod 200A of the second side-fence position indicator 200 into the hole 103D. The racks 102A and 103A are arranged in parallel and moves associated with each other via a pinion 300 that is arranged therebetween.

The side fences 102 and 103, the side-fence position indicator 200, and the racks 102A and 103A make a unit by melting heads of the support rods 102B, 103B, and 200A by heat.

As a result, the side fences 102 and 103, and the side-fence position indicators 200 can work together as the racks 102A and 103A symmetrically move with respect to the pinion 300. The hole 102C is displaced from the hole 102D, and the hole 103C is also displaced from the hole 103D. To align the side fences 102 and 103 and the side-fence position indicators 200 in the sheet-width direction, a width of the side fences 102 and 103 (L1) and a width of the side-fence position indicators 200 (L2) is adjusted (L1<L2) so that positions of outer sides of the side fences 102 and 103 agree with positions of outer sides of the side-fence position indicators 200 with respect to the sheet-width direction.

Figure 6:
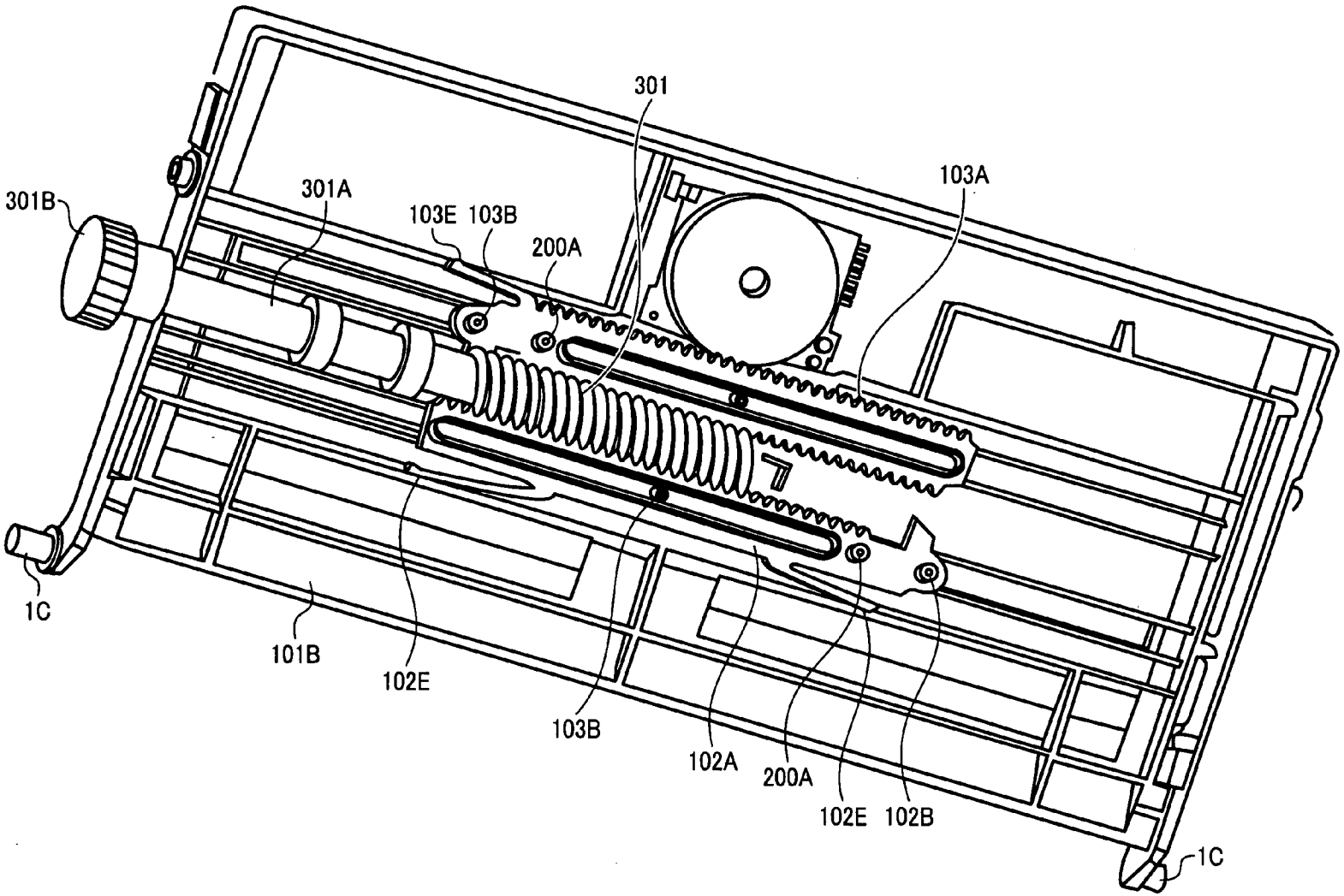
FIG. 6 is a perspective view for explaining another mechanism of interlocking the side fences with side-fence position indicators shown in FIG. 5.

A mechanism that relatively moves the side fences 102 and 103 in the sheet-width direction, for the mechanism that interlocks the side fences 102 and 103, and the side-fence position indicators 200 using the racks 102A and 103A has a configuration as shown in FIG. 6.

Figure 7:
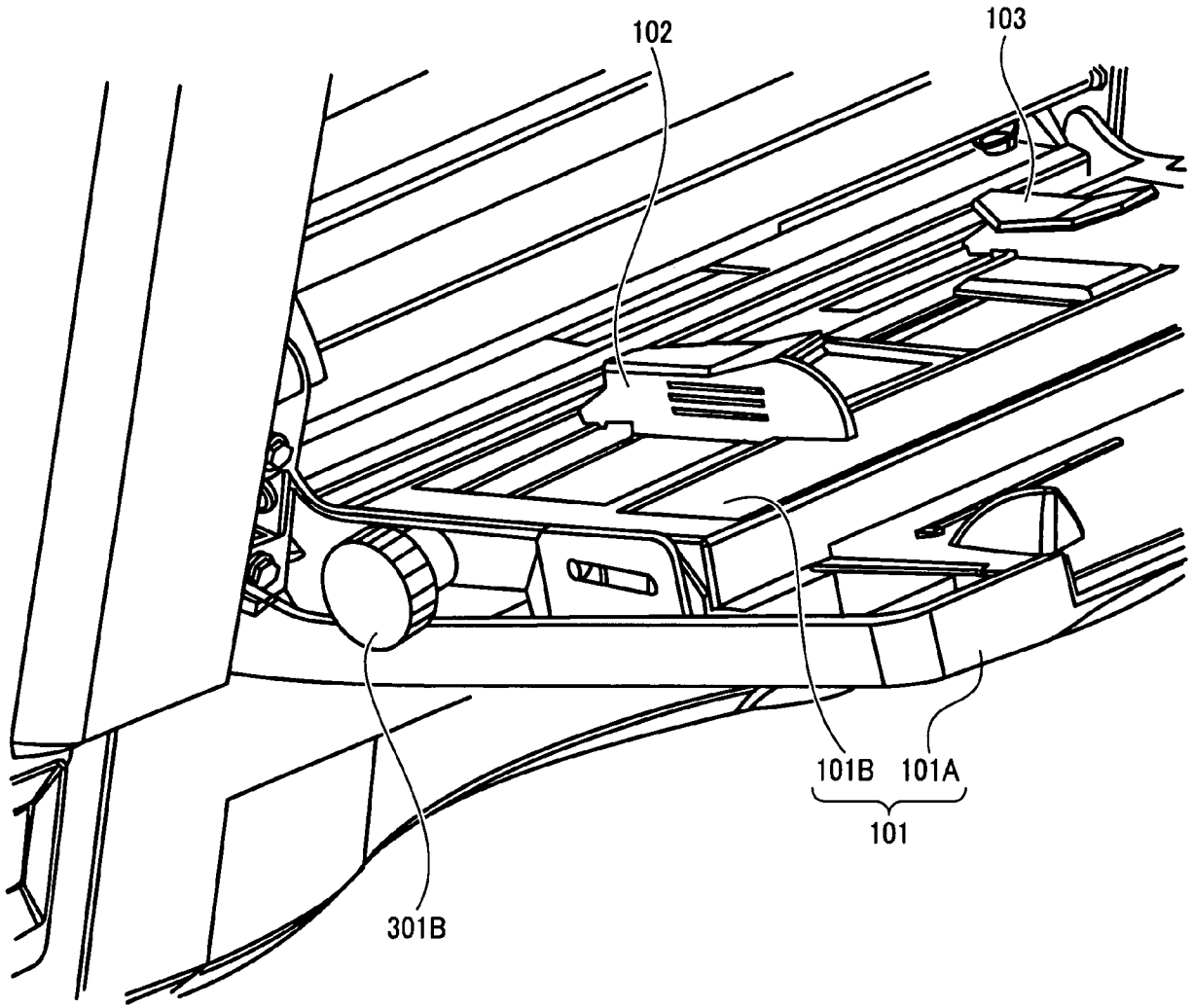
FIG. 7 is a perspective view for explaining an operation unit in the another mechanism shown in FIG. 6.

The mechanism shown in FIG. 6 uses a worm 301 instead of the pinion 300 shown in FIG. 5, and the racks 102A and 103A are worm gears (for convenience, referred to as racks) that engage with the worm 301. For simplicity, FIG. 6 depicts only the support rods 102B and 103B of the side fences 102 and 103 and the support rods 200A of the side-fence position indicators 200, which are combined with the racks 102A and 103A. The corresponding fences are omitted. An end of a shaft 301A of the worm 301 is extended toward the side of the stack plate 101B, and an operation dial 301B (see FIG. 7) is attached to the end. When the operation dial 301B is rotated, the racks 102A and 103A are driven according to the rotation direction, thereby moving the side fences 102 and 103 in the relative direction.

In the symmetrical movement mechanism using the combination of the racks 102A and 103A and the pinion 300 as shown in FIG. 5, movements of the side fences 102 and 103 and the side-fence position indicators 200 can be restricted to prevent inadvertent misalignment.

Moreover, the racks 102A and 103A can include flexible portions 102E and 103E. The flexible portions 102E and 103E frictionally contact with a member to be fitted with and guided by the flexible portions to achieve a braking effect, thereby keeping the side fences 102 and 103 at set positions. In the present embodiment, these flexible portions can be replaced by a configuration as shown in FIG. 12.

Figure 12:
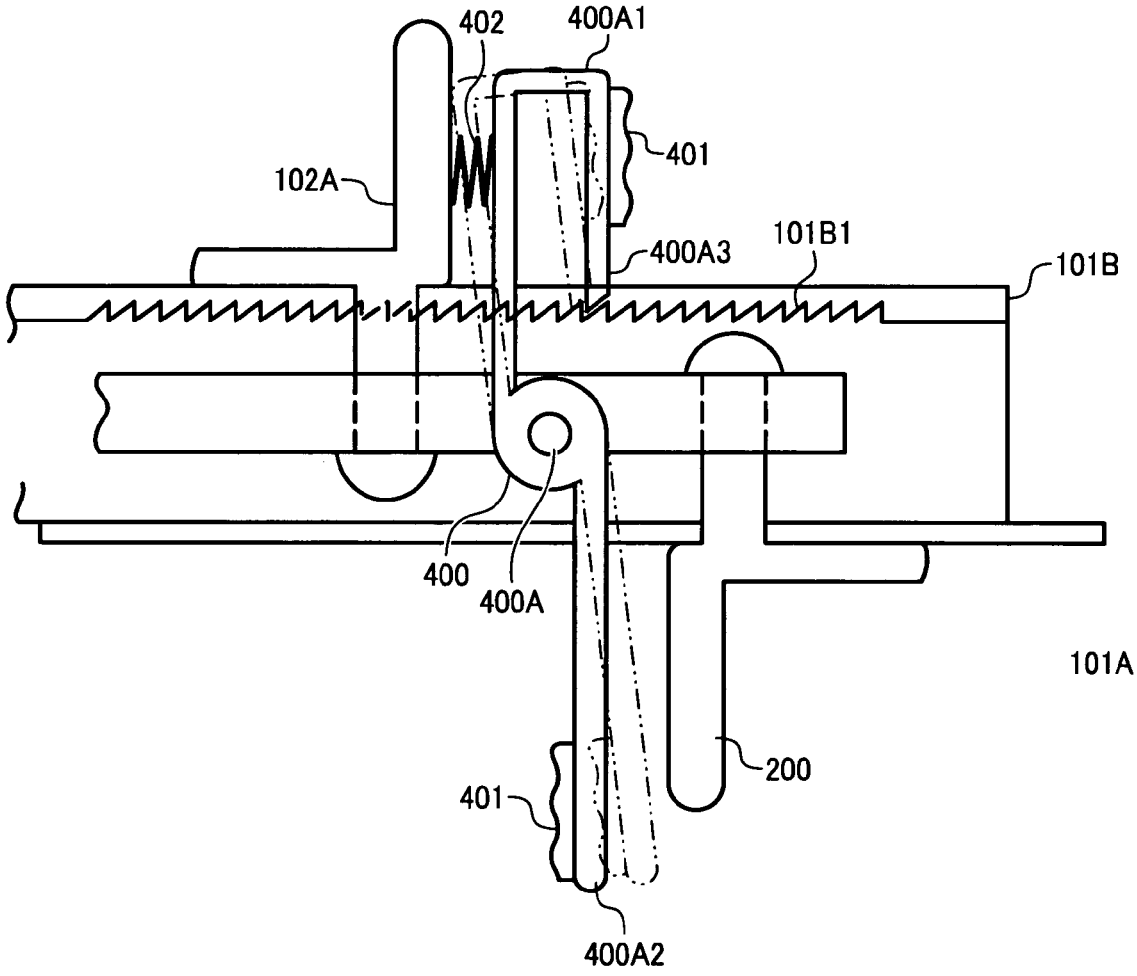
FIG. 12 is a side view of a rack for explaining a lock mechanism of the side-fence position indicators shown in FIG. 11.

FIG. 12 is a side view of the rack 102A that the side fence 102 and one of the side-fence position indicators 200 are combined with. The rack 103A that the side fence 103 and the other of the side-fence position indicators 200 are combined with has a similar configuration.

As shown in FIG. 12, the rack 102A includes an engaging member 400 that has operating portions 400A1 and 400A2 on opposite ends. The operating portions 400A1 and 400A2 swing symmetrically with respect to a support pin 400A like a seesaw.

The engaging member 400 includes pressing operation units 401 on which the user can perform an operation at the corresponding ends of the operating portions 400A1 and 400A2. An engaging pawl 400A3 is formed at the tip of the operating portion 400A1.

The engaging pawl 400A3 faces an engaging tooth 101B1 that is provided on the stack plate 101B.

The operating portion 400A1 includes an elastic member 402 at an opposite position from the pressing operation unit 401 and between the operating portion 400A1 and the side fence 102. The engaging pawl 400A3 is urged by the elastic member 402, thereby normally engaging with the engaging tooth 101B1.

With this configuration, the side fences 102 and 103, and the side-fence position indicators 200 are kept in place in a state where the engaging pawl 400A3 is engaged with the engaging tooth 101B1 due to urge by the elastic member 402.

When the positions of the side fences 102 and 103 are adjusted using the side-fence position indicators 200 or adjusted on the side of the side fences, the engaging member 400 is rotated against the urge by the elastic member 402. This causes the engaging pawl 400A3 to release the engagement with the engaging tooth 101B1. Accordingly, the side fences 102 and 103 can be moved in the sheet-width direction. In this configuration, the pressing operation unit 401 is provided on each end of the engaging member 400. Therefore, the adjustment of the positions of the side fences 102 and 103 from the side of the side-fence position indicators 200 can be easily performed.

Another embodiment of the present invention is explained below.

In this embodiment, the states of the side fences 102 and 103 can be checked externally when the manual feed-tray 101 is tilted to be opened.

That is, through the cover 101A having a surface on which the side-fence position indicators 200 are exposed, the side fences 102 and 103 are seen externally, near the moving paths of the side-fence position indicators 200, i.e., the movement paths along the sheet-width direction.

As the configuration that allows the user to see through the side fences 102 and 103 externally, a portion near the movement paths of the side fences 102 and 103 on the cover 101A and the stack plate 101B is formed by a transparent member, to allow the user to check the positions of the side fences 102 and 103 and the states of the stacked sheets from under the cover 101A. Instead of the transparent member, a window formed by a slit running from a maximum width position to a minimum width position of sheets to be stacked, or windows formed by circular holes that are provided at positions corresponding to sizes of the sheets to be stacked (windows formed by circular holes as shown in FIG. 5) can be provided.

Figure 8:
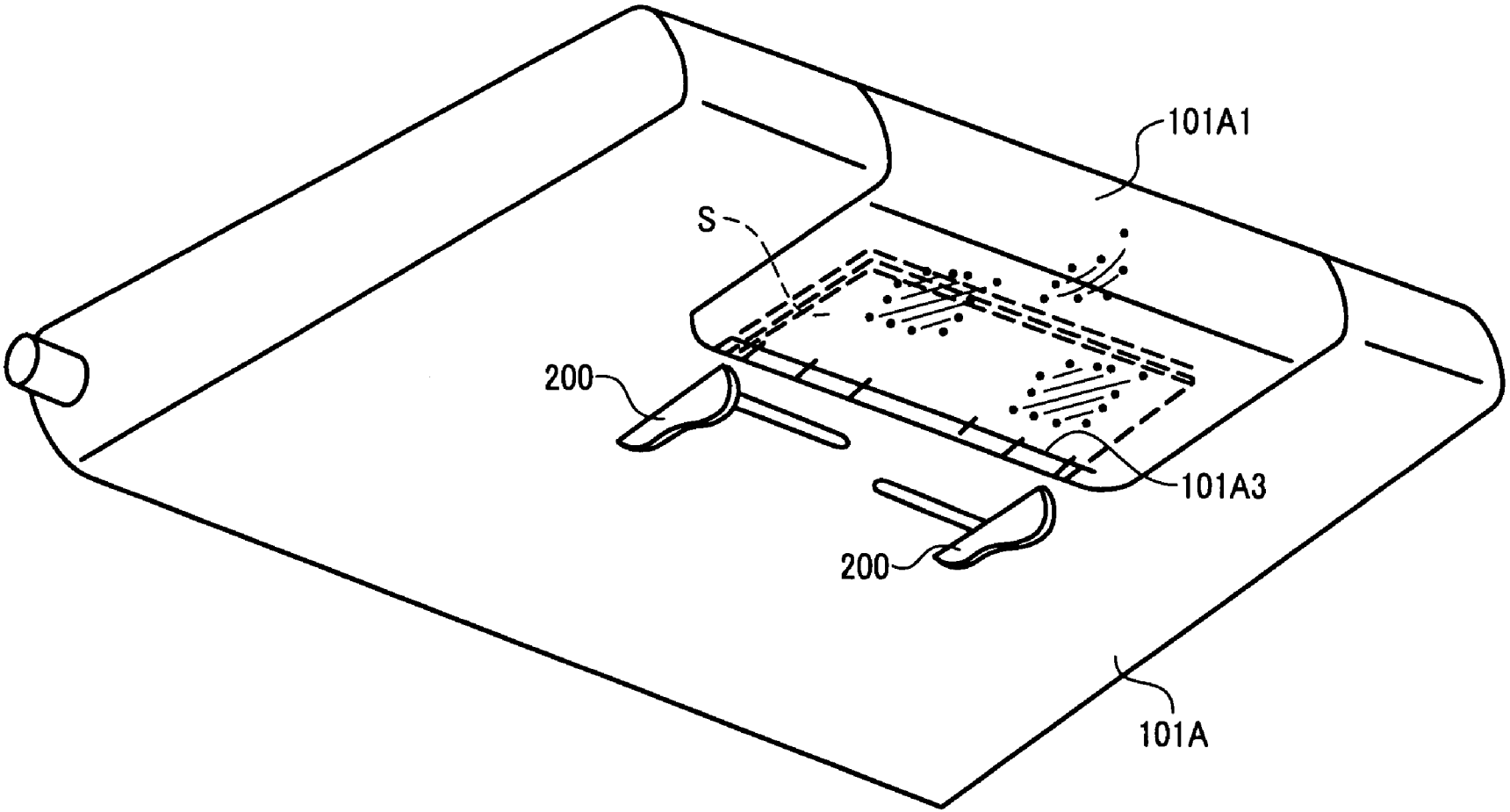
FIG. 8 is a perspective view of an outer surface of a cover that is used for a manual paper-feeding device shown in FIG. 3.

As another example of the transparent configuration, the open end of the cover 101A can be formed by a transparent member 101A1, as shown in FIG. 8. With this configuration, the states of the stacked sheets can be checked from the underside of the manual feed-tray 101. That is, whether the both side edges of the side fences are aligned with the sheets to prevent skew or whether the sheets run upon the side fences can be checked.

On the surface of the cover 101A, a side-fence-position display unit is provided to allow the user to determine from outside the positions of the side fences that are aligned with the side edges of the sheets restricted by the side fences 102 and 103.

Figure 9:
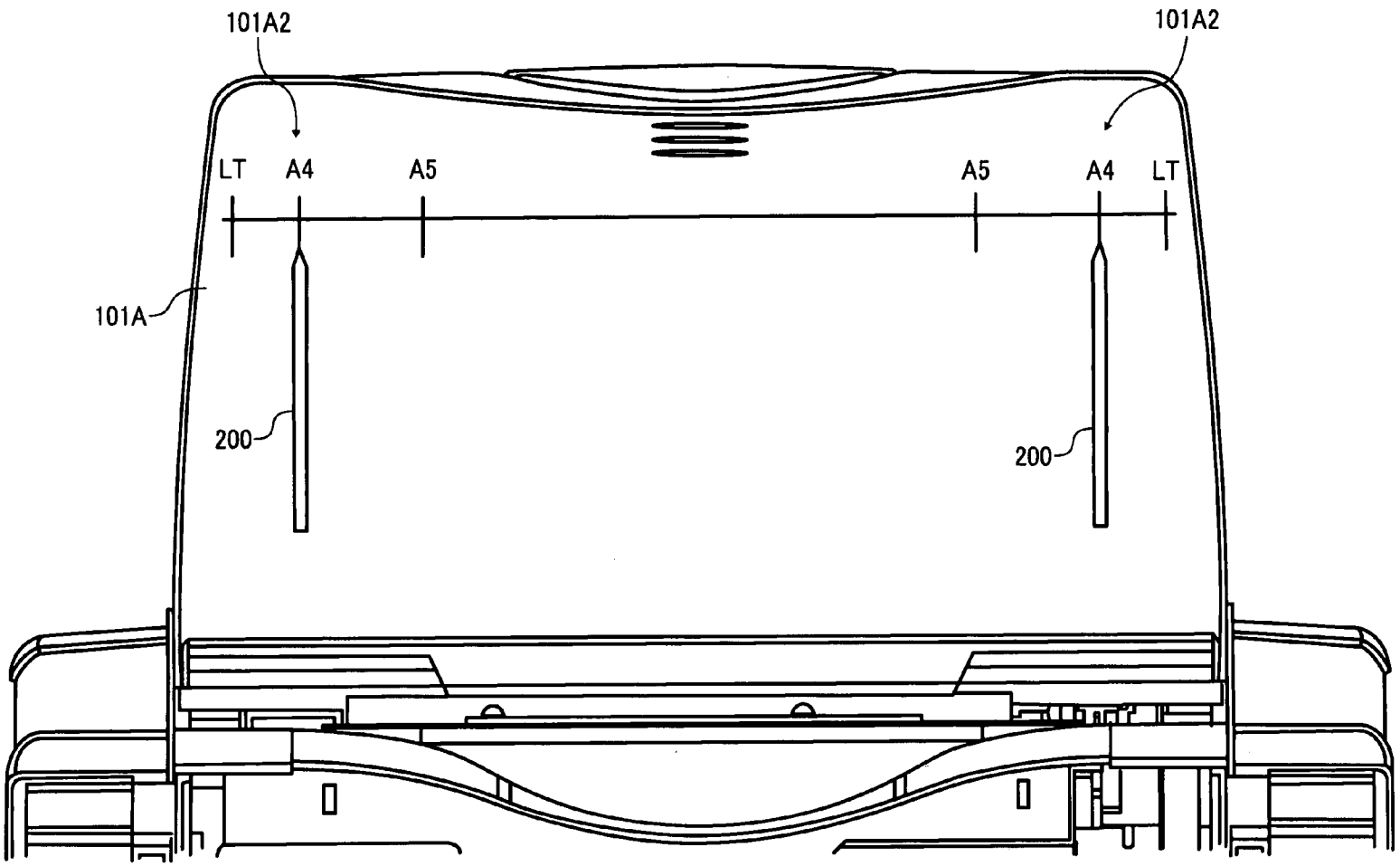
FIG. 9 is a perspective view of the outer surface of the cover shown in FIG. 8 provided with the side-fence position indicators.

FIG. 9 is a perspective view of an outer surface of the cover 101A. On the open end of the cover 101A, in other words on an end corresponding to the rearward of the feeding direction, a plurality of sheet-size marks 101A2 are provided along the moving direction of the side-fence position indicators 200 by impressing, stamping, or attaching printed stickers.

Figure 10:
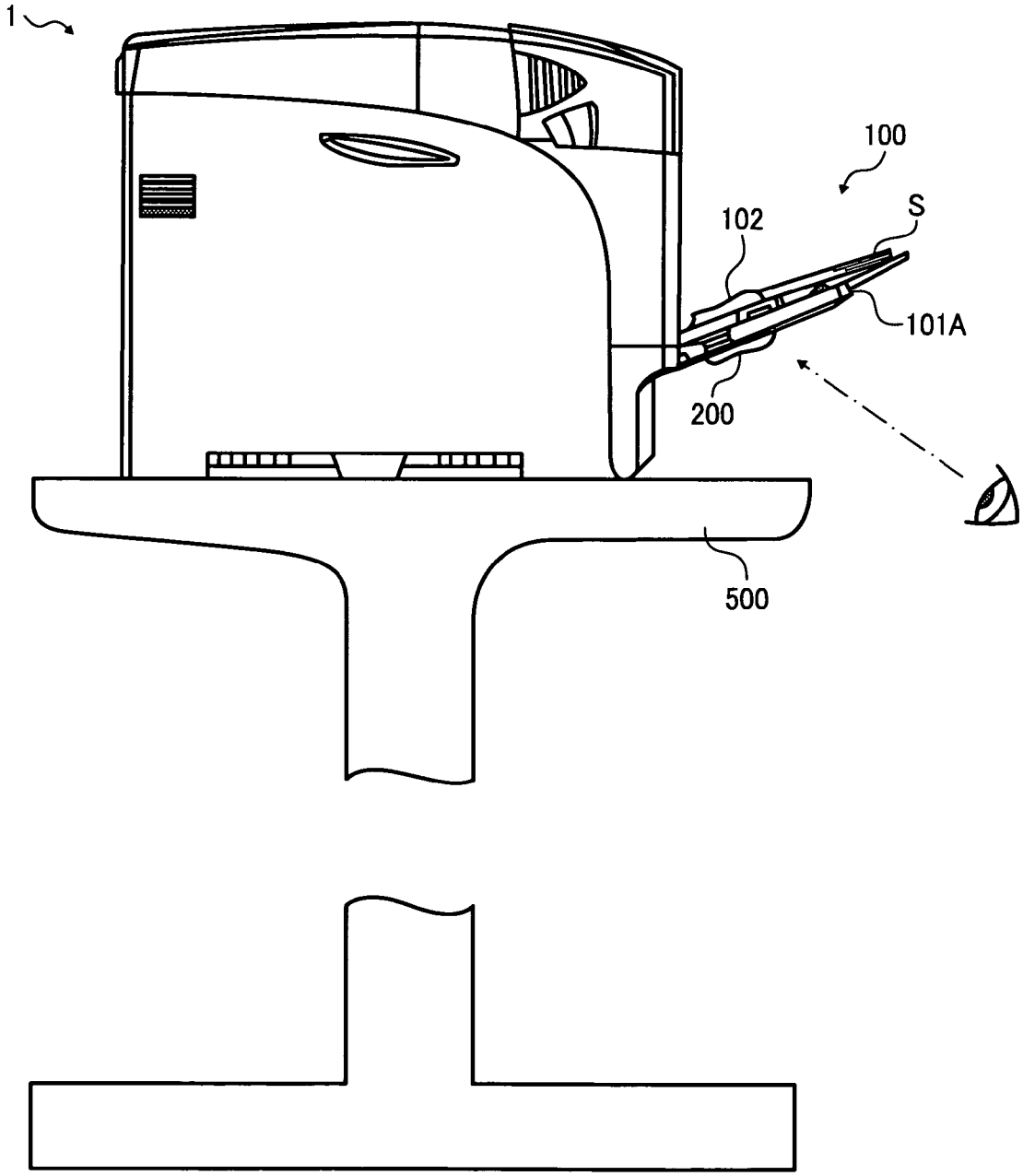
FIG. 10 is a schematic diagram for explaining an effect of the image forming apparatus that is equipped with the paper-feeding device shown in FIG. 1.

When the manual feed-tray 101 is tilted from the side wall of the housing 1A, the side-fence position indicators 200 are exposed on the underside of the cover 101A. Accordingly, as shown in FIG. 10, when the image forming apparatus 1 is placed on a shelf 500 above the user's eye level, the positions of the side fences 102 and 103 can be adjusted while checking the positions of the side-fence position indicators 200 on the underside of the cover 101A of the manual feed-tray 101 that is tilted from the side wall.

When the positions of the side fences 102 and 103 on the stack face of the stack plate 101B do not match the size of stacked sheets, the positions of the side fences 102 and 103 must be aligned with the side edges of the stacked sheets. In the present embodiment, the positions of the side fences 102 and 103 can be moved by moving the side-fence position indicators 200 in the sheet-width direction from the underside of the manual feed-tray 101. Therefore, the user can adjust the positions of the side fences to the side edges of the stacked sheets, without touching the stack face.

Moreover, the positions of the side fences 102 and 103 can be checked by seeing the manual feed-tray from undersurface. Therefore, the adjusted positions of the side fences 102 and 103 can be checked, or the positional relationship between the side fences 102 and 103 and the side-fence position indicators 200 can be properly determined.

In the present embodiment, the side-fence position indicators 200 protruding from the surface of the cover 101A can be turned, that is, can be folded up. This configuration is explained below.

Figure 11:
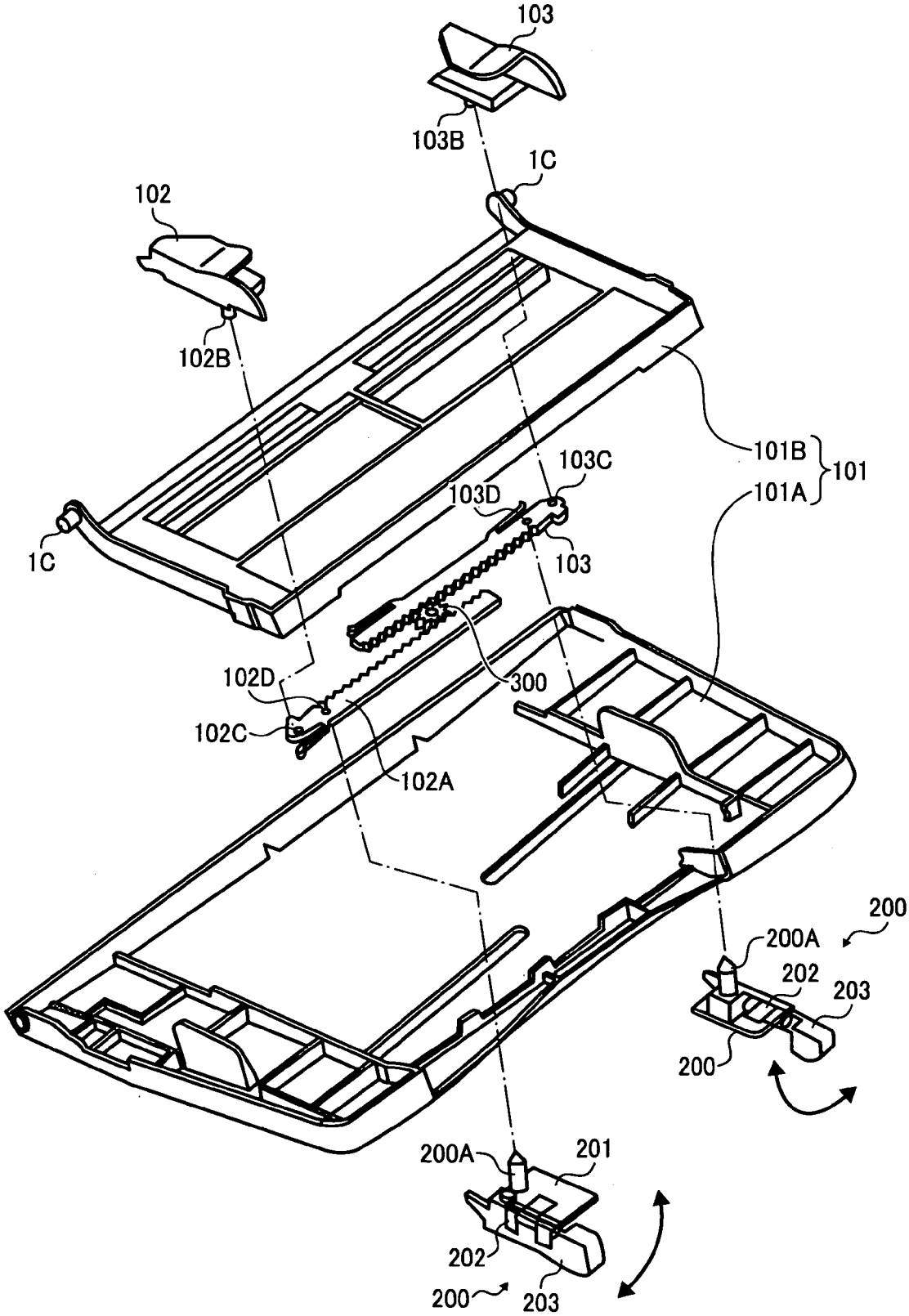
FIG. 11 is a perspective view for explaining a modification of the mechanism shown in FIG. 5.

As shown in FIG. 11, each of the side-fence position indicators 200 includes a horizontal portion 201 including a support rod 200A that is inserted through the rack, and a rising portion 203 that is rotatably supported to the horizontal portion 201 by a hinge 202 or the like.

Although not described in detail, the hinges 202 are locked at 90-degree rocking positions. The rising portions 203 can be rotated in directions shown by arrows in FIG. 11 by a force larger than an urge force that is necessary to lock. The horizontal portions 201 include recessed portions into which the hinges 202 are fitted. The horizontal portions 201 other than the recessed portions are convex to be abutted by the side edges of the sheets.

With this configuration, when the cover 101A is lifted up to form part of the side wall of the image forming apparatus 1, the rising portions 203 of the side-fence position indicators 200 can be turned to be folded-up. The appearance can be prevented from being damaged, and the user's hands can be prevented from carelessly touching the rising portions 203. When the manual feed-tray 101 is of a type that is pulled out from the housing 1A to expose the stack face, the rising portions 203 are folded up when retracted within the housing 1A, so as not to cause an obstruction when the manual feed-tray 101 is slid.

In this configuration, the positions of the side-fence position indicators 200, particularly in the sheet feeding direction are not specified. The positions of the side-fence position indicators 200 are preferably on the side of the rocking end of the cover 101A, i.e., near the rotation support of the cover 101A. This prevents torsion or deflection deformation of the cover 101A due to load that is caused when the side-fence position indicators 200 are moved for adjustment of the positions of the side fences 102 and 103.

In the present embodiment, a configuration is provided that can identify the states of stacked sheets on the stack plate 101B using the configuration that enables the positions of the side fences 102 and 103 to be seen through outside.

The configuration using the transparent body as shown in FIG. 8 is explained below.

As shown in FIG. 8, the transparent member 101A1 in this case has an opening of a width corresponding to the maximum width of the sheets to be stacked. A sheet-position reference line 101A3 parallel to the sheet-width direction is provided on the underside of the transparent member 101A1 or on a side surface of a side edge of the transparent member 101A1 (a case that the sheet-position reference line 101A3 is provided on the side surface of a side edge is shown in FIG. 8).

The sheet-position reference line 101A3 is provided at a position where the ends of the sheets stacked on the stack plate 101B of the manual feed-tray 101 can be checked from the underside of the manual feed-tray 101. This allows the user to visually check whether the stacked sheets S are parallel to this line, from outside. In the configuration shown in FIG. 8, the sheet-size marks 101A2 can be used additionally.

This configuration allows the user to determine whether the rearward edge with respect the feeding direction of the stacked sheets S are all made parallel to the sheet-position reference line 101A3. Therefore, when the rearward edge of the sheets S are parallel to the sheet-position reference line 101A3 and both side edges of the sheets S face the side fences 102 and 103, the user can promptly determine that the sheets are normally stacked, without standing up each time to look inside from the upper surface of the stack plate 101B.

When the sheet-position reference line 101A3 and the rearward edge of the sheets S relative to the feeding direction are not parallel while the side edges of the sheets S are located within the side fences 102 and 103, the user can determine that sheets S are deflected or curled. In this case, the stacked sheets can be taken out to be stacked again.

Even when the image forming apparatus 1 is placed above the user's eye level, all the user has to do is the stacking operation of the sheets, and the user does not need to make a motion of standing each time to look into from upward of the stack plate 101B to check the state of the stacked sheets. Therefore, the operability in placing the sheets can be improved.

In the present embodiment, the manual feed-tray 101 can be opened from the side wall of the image forming apparatus 1 by tilting the manual feed-tray 101. The present invention can be also applied to a feed tray that can be removed by a pull-out operation.

In the present embodiment, the members that move with the side fences are used as the configuration that indicates the positions of the side fences. As the configuration that indicates the positions of the side fences, a configuration can be used that uses a sensor that detects the positions of the side fences and displays the positions of the side fences at a position other than the stack face based on a signal from the sensor.

As the configuration that displays the positions of the side fences, any face other than the sheet stack face of the paper-feeding device, such as the right or left side and a face corresponding to the rearward end of the sheets relative to the moving direction can be used, in addition to the underside of the tray as described in the present embodiment.

The side-fence position indicators can be formed integrally with the side fences. In this case, a resin member is integrally molded to pass through the sheet stack face. In this way, the side fences and the side-fence position indicators can be formed as one member.

In the embodiment described above, the side-fence position indicators are moved associated with movement of the side fences. This allows the side fences to be moved by an operation from not only the stack surface but also another surface. Thus, the operability in aligning the side fences can be improved.

According to an embodiment of the present invention, in addition to the side fences that are provided on a stack face for recording sheets in a paper-feeding device, a side-fence position indicator is provided that can adjust positions of side edges of the recording sheets. Accordingly, even when the stack face for the recording sheets is above the user's eye level, the user can check matching of the size of the recording sheets to be stacked and the side fences even from a seated position. The side fences can be controlled according to the size of the stacked recording sheets, from the underside of the paper-feeding device, which is different from the stack face. This eliminates the need for the user to stand up each time or reach his/her hand for the stack face to control the side fences, thereby improving the operability.

Moreover, the side-fence position indicator is combined with racks or worm gears that are used to move the side fences. Therefore, the need to provide a special mechanism of interlocking the side fences and the side-fence position indicator is eliminated. This prevents increase in the cost and improves the operability when the stack face for the recording sheets is located above the user's eye level. Particularly when the side fences and the side-fence position indicator are moved simultaneously only by a rotational operation of a worm, an operation of moving the side fences on the stack face that is located on the upper surface of a manual feed-tray is dispensed with, thereby facilitating the operation.

Furthermore, a configuration that defines interlocked positions of the side fences and the side-fence position indicator is provided. Therefore, careless displacement of the defined positions is prevented, so that the positions of the side fences are prevented from being displaced when the recording sheets are stacked on the stack face above the user's eye level.

Moreover, a configuration that allows the user to see through the recording sheets stacked on the stack face of the manual paper-feeding device, from the underside opposite the stack face is provided. Therefore, even when the stack face is located above the user's eye level, the user can check the states of the stacked recording sheets.

Furthermore, the side-fence position indicator is formed by fence members similar to the side fences. Therefore, common components can be used, which prevents increase in the cost, unlike a case of using other kinds of components.

Moreover, the side-fence position indicator does not interfere with a removable member that is located on an opposite side from the stack face and below the manual paper-feeding device when the manual paper-feeding device is tilted or retracted. Therefore, for example when a member to be replaced is located below, the replacement operation is not obstructed even when the paper-feeding device is in an open-position.

Furthermore, the side-fence position indicator has a transparent portion. Therefore, the user can visually check states of the side edges of the recording sheets by seeing the recording sheets through the transparent portion from under the manual paper-feeding device. Accordingly, the state of alignment of the side edges of the recording sheets by the side fences can be checked from under the manual paper-feeding device. This eliminated the need of such an operation that the user who is seated stands up each time to check the states of the stacked recording sheets.

Moreover, the side-fence position indicator is provided to be able to fold up. Therefore, when the manual paper-feeding device is lifted up from the tilted position to form part of a side wall of the apparatus or when the manual paper-feeding device is moved from a pulled-out position to a storage position, the side-fence position indicator does not protrude beyond the outer surface of the apparatus. This provides good appearance, and does not cause an obstruction to the apparatus being slid or to the surrounding. Besides, support shafts that are provided to racks or movable members as the existing configurations are used for a configuration for folding supports. Therefore, the effect above mentioned can be achieved without any special folding configuration.

Furthermore, the side-fence position indicator is provided on the manual paper-feeding device close to a rotation axis of the manual paper-feeding device. This reduces moment generated when the side-fence position indicator moves, thereby preventing deformation of the manual paper-feeding device.

Moreover, a size indicator for checking the size of the recording sheets is provided on a face of the manual paper-feeding device, on which the side-fence position indicator is located. Therefore, the positions of the side fences can be adjusted from a side on which the side-fence position indicator is located, i.e., from the underside of the manual paper-feeding device. This facilitates adjustment of positions at which the side edges are aligned when the recording sheets are stacked.

Furthermore, a member for checking states of the stacked recording sheets is provided on the stack face of the manual paper-feeding device, and the member has a reference line. Therefore, only seeing through orientation of the edges of the recording sheets to the reference line, the user can easily determine the states of the stacked sheets from the underside of the manual paper-feeding device. This allows the user to check the states of the stacked sheets without changing his/her position from the seated position.

Moreover, the operability in using the manual paper-feeding device when the manual paper-feeding device is located above the eye level of the user who is seated can be improved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A paper-feeding device for use in an image forming apparatus and attached to a main body of the image forming apparatus, the paper-feeding device comprising:

a pivotally opening and closing tray on which a recording sheet is configured to be stacked, the tray having an upper surface and a lower surface both being exposed to outside of the image forming apparatus during use;

two side fences that are used for adjusting a position of the stacked recording sheet, the side fences being movably attached to the upper surface;

two side-fence position indicators on the lower surface of the tray that indicate a position of the side fences;

a worm that is arranged in a manner that a rotation axis of the worm is parallel to a sheet-width direction of the stacked recording sheet, the worm being extended beyond the tray and having an operation dial on one end that is exposed outside; and two movable members that are arranged parallel to each other and mesh with each other via the worm whereby moving in a symmetric manner associated with rotation of the operation dial, wherein a corresponding one of the side fences being firmly attached to a corresponding one of the movable members, and side-fence position indicators being movably attached to the lower surface, a corresponding one of the side-fence indicators being firmly attached to a corresponding one of the movable members, whereby the side fences, the side-fence position indicators, and the movable members move integrally.

2. A paper-feeding device for use in an image forming apparatus and attached to a main body of the image forming apparatus, the paper-feeding device comprising:

a pivotally opening and closing tray on which a recording sheet is configured to be stacked, the tray having an upper surface and a lower surface both being exposed to outside of the image forming apparatus during use;

two side fences that are used for adjusting a position of the stacked recording sheet, the side fences being movably attached to the upper surface;

two side-fence position indicators on the lower surface of the tray that indicate a position of the side fences;

two racks that are arranged parallel to each other and mesh with each other via a pinion, wherein a corresponding one of the side fences being firmly attached to a corresponding one of the racks, and the side-fence position indicators being movably attached to the lower surface, a corresponding one of the side-fence position indicators attached to a corresponding one of the racks, whereby the side fences, the racks, and the side-face position indicators move integrally, wherein the tray includes engaged teeth that are arranged along a moving direction of the side fences and the side-fence position indicators; and an engaging member that swings symmetrically with respect to a fulcrum positioned on one of the racks, the engaging member including an engaging pawl on one end that engages with one of the engaged teeth, wherein the engaging member receives a force to cause the engaging pawl engaging with one of the engaged teeth, and when the engaging member swings in a direction against the force, the racks move.

3. The paper-feeding device according to claim 2, wherein the side-fence position indicators move in association with the side fences.

4. The paper-feeding device according to claim 1, wherein the tray includes engaged teeth that are arranged along a moving direction of the side fences and the side-fence position indicators; and an engaging member that swings symmetrically with respect to a fulcrum positioned on one of the movable members, the engaging member including an engaging pawl on one end that engages with one of the engaged teeth, wherein the engaging member receives a force to cause the engaging pawl engaging with one of the engaged teeth, and when the engaging member swings in a direction against the force, the movable members move.

5. The paper-feeding device according claim 2, wherein the tray includes a transparent portion near a path along which the side fences and the side-fence position indicators move.

6. The paper-feeding device according to claim 2, wherein the tray has at least one through-hole that is positioned near a path along which the side fences and the side-fence position indicators move, the upper surface can be seen through the through-hole.

7. The paper-feeding device according to claim 2, wherein the tray includes a transparent portion in a side farther away from the image forming apparatus.

8. The paper-feeding device according to claim 2, wherein the side-fence position indicators are formed by fence members similar to the side fences.

9. The paper-feeding device according to claim 2, wherein a height of the side-fence position indicators in a direction orthogonal to the tray is set to a predetermined value so that the side-fence position indicators do not interfere with a member that is located under the side-fence position indicators.

10. The paper-feeding device according to claim 2, wherein the side-fence position indicators are attached to the lower surface in a pivotable manner that a substantially-vertical face of the side-fence position indicators moves to a position in contact with the lower surface.

11. The paper-feeding device according to claim 10, wherein the corresponding one of the side-fence position indicators is attached to the corresponding one of the racks in such a manner to be pivotable around a support axis of the corresponding rack that the substantially-vertical face moves to the position in contact with the lower surface.

12. The paper-feeding device according to claim 2, wherein the side-fence position indicators are attached to the lower surface at positions close to the image forming apparatus and movable in a sheet-width direction of the stacked recording sheet.

13. The paper-feeding device according to claim 2, wherein the tray includes a size indicator on the lower surface for determining a size of the stacked recording sheet.

14. The paper-feeding device according to claim 2, wherein the tray has a transparent portion for checking a state of the stacked recording sheet.

15. The paper-feeding device according to claim 14, wherein the transparent portion has a reference line parallel to a sheet-width direction of the stacked recording sheet.

16. An image forming apparatus comprising a paper-feeding device including:

a pivotally opening and closing tray on which a recording sheet is configured to be stacked, the tray having an upper surface and a lower surface both being exposed to outside the image forming apparatus during use;

two side fences that are used for adjusting a position of the stacked recording sheet, the side fences being movably attached to the upper surface;

two side-fence position indicators on the lower surface of the tray that indicate a position of the side fences;

a worm that is arranged in a manner that a rotation axis of the worm is parallel to a sheet-width direction of the stacked recording sheet, the worm being extended beyond the tray and having an operation dial on one end that is exposed outside; and two movable members that are arranged parallel to each other and mesh with each other via the worm whereby moving in a symmetric manner associated with rotation of the operation dial, wherein a corresponding one of the side fences being firmly attached to a corresponding one of the movable members, and the side-fence position indicators being movably attached to the lower surface, a corresponding one of the side-fence indicators being firmly attached to a corresponding one of the movable members, whereby the side fences, the side-fence position indicators, and the movable members move integrally.

17. The paper-feeding device according to claim 2, further including a support pin at a proximal end of the tray, the tray being hinged to the image forming apparatus by the support pin.

* * * * *